United States Patent [19]

Carillo

[11] 4,367,450

[45] Jan. 4, 1983

[54] ELECTRICAL REACTOR CONSTRUCTION

[76] Inventor: Ernie Carillo, 1619 Whitestone, Spring Valley, Calif. 92077

[21] Appl. No.: 228,316

[22] Filed: Jan. 26, 1981

[51] Int. Cl.[3] ..... H01F 5/00; H01F 27/30

[52] U.S. Cl. ..... 336/200; 336/223; 336/232; 361/303

[58] Field of Search ..... 336/200, 206, 223, 232, 336/229; 361/303, 306, 307; 338/314, 320

[56] References Cited

U.S. PATENT DOCUMENTS

| | | | |
|---|---|---|---|
| 3,011,106 | 11/1961 | Ducati | 361/307 X |
| 3,089,106 | 5/1963 | Saaty | 336/200 |
| 3,798,059 | 3/1974 | Astle et al. | 336/229 |
| 3,812,442 | 5/1974 | Muckelroy | 336/232 X |
| 3,833,872 | 9/1974 | Marcus et al. | 336/200 X |
| 3,848,210 | 11/1974 | Felkner | 336/232 X |
| 4,115,833 | 9/1978 | Cirkel | 361/303 |
| 4,310,821 | 1/1982 | Frances | 336/200 |

FOREIGN PATENT DOCUMENTS

| | | | |
|---|---|---|---|
| 2379229 | 1/1977 | France | 336/200 |
| 772528 | 4/1957 | United Kingdom | 336/200 |
| 993265 | 5/1965 | United Kingdom | 336/200 |

*Primary Examiner*—Thomas J. Kozma

*Attorney, Agent, or Firm*—Charmasson, Branscomb & Holz

[57] ABSTRACT

A system of creating coils, windings, inductors and capacitors utilizes wafer stacks having suitable pass-throughs and voids in the insulation portion of the wafer to permit one of several different types of these electrical elements to be made according to the particular orientation and order in which the wafers are stacked, each wafer comprising a thin insulator panel with a conductive film across one surface, which could possibly be created photographically.

1 Claim, 25 Drawing Figures

ELECTRICAL REACTOR CONSTRUCTION

BACKGROUND OF THE INVENTION

The invention is in the field of electrical coils, windings, and reactors including capacitors and inductors, although it particularly applies to inductor construction.

Typically, coils, windings and inductors are made by winding continously a wire or wires around an iron core or hollow core depending on the use. This is a process that naturally requires a certain amount of finesse, especially in the making of large inductance elements. In spite of the fact that a great many electrical and electronic components are now made solid state or photographically, typically coils and windings are sill created in the same traditional manner of winding the wire about a core.

Aside from the manufacturing complexity of the wire technique, also generally speaking the winding inductor, or capacitor, must be pre-tailored to a specific magnetic strength, resistance, inductance or capacitance, qualities which aside from elements, specifically manufactured to be variable, cannot be easily adapted on site to particular specifications.

SUMMARY OF THE INVENTION

The present invention solves the above stated problem by providing wafer elements each constituting an insulator panel on which a film of conductor is photographically or otherwise applied and shaped, with these wafers being collated or stacked to create the particular element desired without requiring any winding. In the several different embodiments, in addition to the general purpose laminarly-constructed wafer coil, are units which may be alternatively arranged to define an inductor or capacitor, one embodiment which may be utilized as an inductor with either a single coil or multiple coaxial coil with the same number of wafers, and yet another embodiment in which a single wafer type can be stacked alternately in upright and inverted position to create an inductor.

One advantage in this type of construction is the simplicity of the actual assembly of the wafers wherein once the wafers have been made, they can be assembled into a coil of any desired coil length without any special equipment. Thus, in addition to completely eliminating the wire winding the equipment required to make a conventional coil, the on-site user is able to determine the electrical qualities required and fabricate a coil very quickly and simply from a supply of wafers, and alternatively in at least one embodiment shown herein, the end user may also rearrange the same wafers, and with the addition of a couple of insulator sheets, create a capacitor rather than an inductor or coil so that the same unit may combine capacitance and inductance to form a filter or resonant circuit in a single component.

DETAILED DESCRIPTION OF THE PREFERRED EMBODIMENTS

The principal concept of the invention is that wafers be provided that are so cut, and that have conductor films on their surfaces that are so contoured, that the wafers may be assembled in a stack to provide a single coil or winding, or in some instances concentric coils, or in some instances capacitors. The wafers shown in the first sheet of drawings are provided in two different types, which are identified as type (a) and type (b), and can be used to define a winding or coil simply by alternating (a)-(b)-(a)-(b)-, etc. or by the utilization of two additional insulator films with the proper orientation these wafers can be reorganized to define a capacitor.

Figure 5:
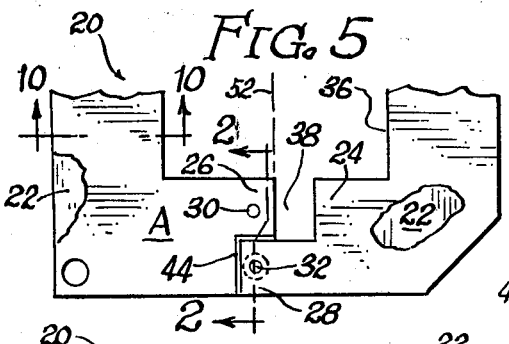
FIG. 5 is a top elevation view of a fragment of a type (a) wafer.
Figure 2:
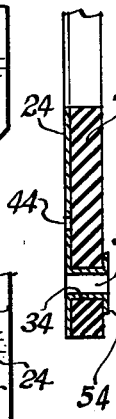
FIG. 2 is a section taken along line 2—2 of FIG. 5.

FIG. 5 indicates at 20 a type (a) wafer of the first embodiment. This wafer has an insulator panel 22 and a conductive film 24 which is shaped around the peripheral areas of the insulator 22, to define a broad conductive loop with adjacent end points 26 and 28 that respectively define a receiving contact 30 which may be contacted from above by another wafer, and a pass-through contact 32 which passes through an aperture 34 as best seen in FIG. 2 to make contact with the receiving contact 30 of a subsequent wafer. It should be noted to clarify the relations in the drawings that the insulative panel 22, which is a rigid form-defining member, may be a continuous flat panel with no apertures other than the aperture 34 for electrical pass-through, in which instance the coil would have no hollow core. However, in the instant embodiment, to make the first illustrated embodiment universally applicable, a central core opening 36 is made through the insulator 22 so that it penetrates the entire panel 20, and an additional adjoining void 38 also passes completely through the insulator as well as the conductor, which as will be understood below, is inoperative in a coil configuration but permits the wafers to be arranged to define a capacitor as well. It should also be noted that the flats 40 and the assembly holes 42 best seen in FIG. 1 have no function other than identification of the wafer and permitting the easy assembly thereof.

Whereas the central core opening 36 and the void 38 pass completely through the insulator, the ends of the conductive inductor 24 must be separated, at least in the coil embodiment, by a narrow open channel 44. This channel need not pass through the insulator, as it would only weaken the structure.

Figure 7:
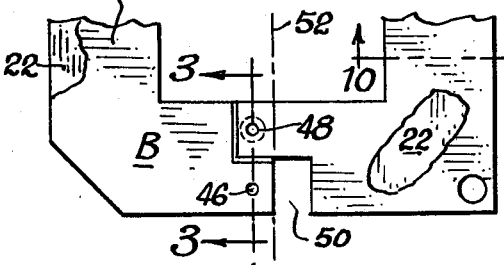
FIG. 7 is a top elevation view of a fragment of a type (b) wafer.

The second type of wafer is the type (b) wafer shown in FIG. 7 et seq which is substantially identical to the first wafer and will be re-numbered only to identify the receiving contact 46, the pass-through contact 48 and the void 50. Both wafers have a longitudinal axis 52 about which they can be rotated for re-orientation in the capacitor assembly described below.

Figure 3:
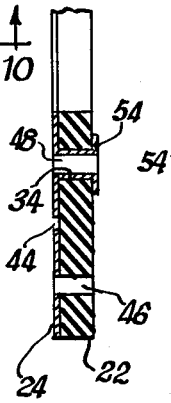
FIG. 3 is a section taken along line 3—3 of FIG. 7.
Figure 9:
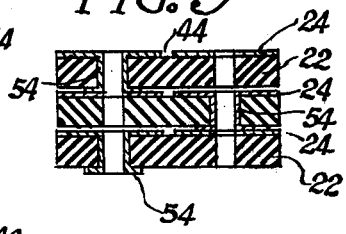
FIG. 9 is a section of the connections between three adjacent wafers in an inductor stack such as FIG. 4.
Figure 8:
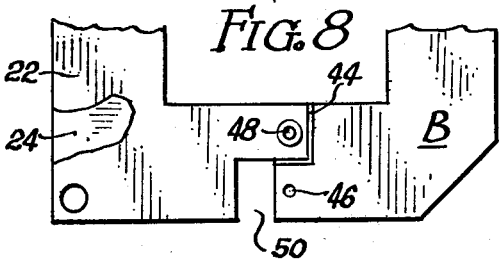
FIG. 8 is a top elevation view of a type (b) wafer upside down.

The pass-through conductors 32 and 48 are preferably formed by an extension of the conductive material from the film 24 and define a thin, rivet-shaped contact 54 shown in FIGS. 2, 3 and 9. Any other suitable pass-through conductor could be used.

Figure 1:
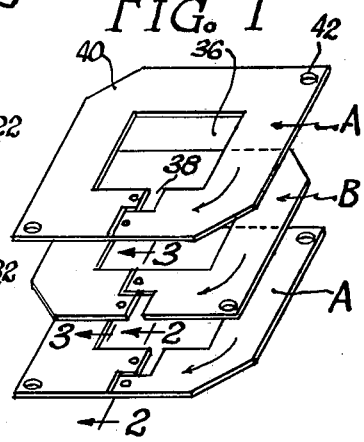
FIG. 1 is a perspective view of a stack of two alternate wafer types.
Figure 6:
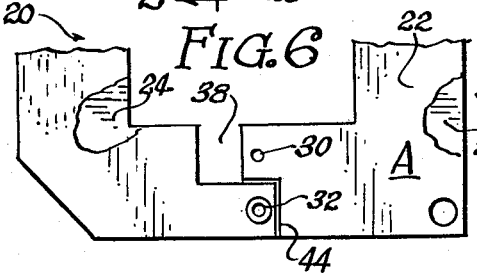
FIG. 6 is a top elevation view of a fragment of a type (a) wafer upside down.

Turning now to the combination of the type (a) and type (b) wafers necessary to create a coil, it can be seen from FIG. 1 that all that is necessary is to alternate type (a) and type (b) in a stack. Due to the configurations of these two variant wafers, the pass-through makes contact to maintain the same rotational direction of current flow like a coiled wire, which is clockwise as seen from the top in FIG. 1. These wafers may be assembled in any number desired, with the contacts automatically being made as shown in FIG. 9, such that a stack shown in FIG. 4 may be created. This stack may be held together with bolts through the assembly holes 42, and a central core 56 could be inserted as shown. This core could, of course, also be rectangular or horseshoe-shaped, or even a bar, and inductively couple a secondary stack so that a transformer is created. The coil could be geometrically modified in any desireable fashion within the bounds of the wafer concept to create windings for motor or generator stator or armature windings, or coil resistors, cathode ray deflector coils, or for any other application calling for a coil or winding.

Figure 11:
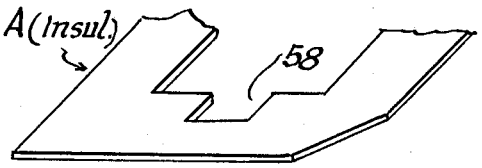
FIG. 11 is a perspective view of a fragment of a type (a) insulator.
Figure 12:
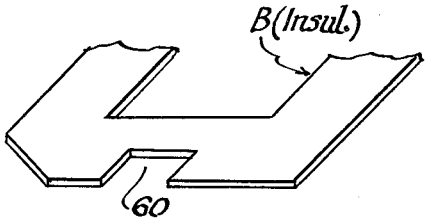
FIG. 12 is a similar view of a type (b) insulator.
Figure 13:
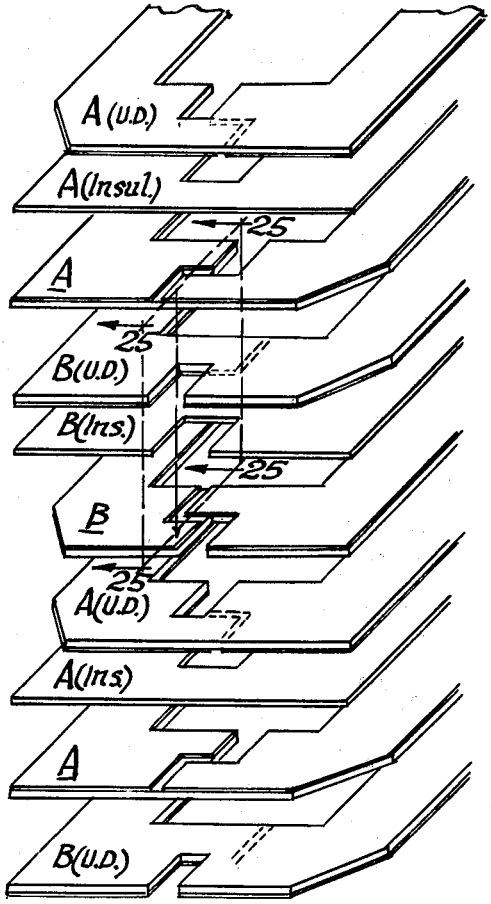
FIG. 13 is a perspective exploded view of a typical stack of elements used to form a capacitor.

It is thus clear that the user of coil may modify at will by unbolting the stack the amount of resistance, inductance and magnetic flux capability inherent in his element. He also may utilize the same wafer configuration to create a capacitor, as shown in FIGS. 11 through 13. The only additional elements required to create a capacitor are two types of insulator layers, type (a) and type (b) which have cutouts at 58 and 60 respectively. When these insulative layers are arranged in the configuration shown in FIG. 13, each insulator on the respective wafer passes through the adjacent wafer to contact the once removed insulator so that the wafers leapfrog in overlapping fashion connecting alternate conductors together to define two separate interstitially alternated conductor groups.

Figure 25:
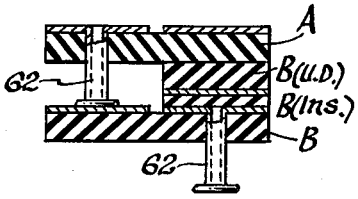
FIG. 25 is a section of a typical capacitor pass-through made according to the disclosure.

To clarify this relation, in FIG. 13 the top layer is a type (a) wafer turned upside down followed by a type (a) insulator, a right side up (a) wafer, an upside down (b) wafer, a (b) insulator, and a right side up (b) wafer, and so forth. A little study will reveal that this is essentially an (a)-(b)(a)-(b) style coil arrangement with an identical arrangement turned upside down and shuffled into the first stack, with the facing conductors being separated by added insulators where necessary. Each pass-through would pass through not only its own insulator but also an adjacent conductor and insulator, so that special pass-throughs 62, indicated in FIG. 25, would need to be used. These could be provided as rivet inserts which could be inserted into the standard pass-throughs of the type (a) and (b) wafers to avoid requiring specialized construction.

The above stated arrangement sets forth two basic styles of wafer, that is type (a) and type (b), that can be combined to create either a coil or capacitor with slight modification. Of course, there are many variations of this, utilizing the same basic configuration including a solid, uninterrupted insulator without a central core opening 36, with the central portion being covered with the conductor film and the elimination of the channel 44 if the wafer is adapted exclusively for use as a capacitor. Conversely, if the wafer is to be used exclusively in an inductor or other coil assembly, the voids 38 can be omitted and several other styles of terminal patterns on the wafers could be used.

Figure 14:
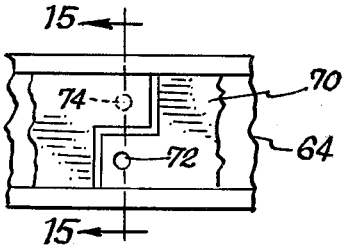
FIG. 14 is a diagrammatic fragmentary view of a modification of the wafer.
Figure 15:
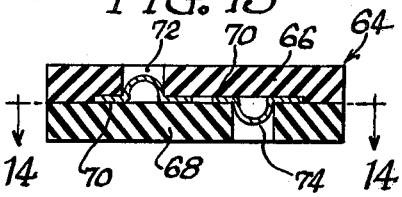
FIG. 15 is a section taken along line 15—15 of FIG. 14.
Figure 16:
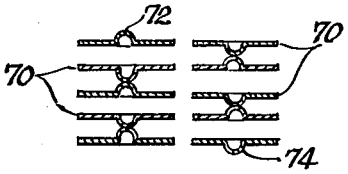
FIG. 16 is a diagrammatic view of the electrical connections in an inductor made from wafers shown in FIGS. 14 and 15.

It would still be necessary to use two different types, type (a) and type (b), of wafer in order to insure that the current continues in either the clockwise or counter-clockwise direction without reversing itself from wafer to wafer. This would be true in an insulator-conductor wafer, although it could be avoided as indicated in FIGS. 14 through 16 if a double-insulated conductor sandwich is used. In this implementation, as shown in FIG. 15, the sandwich 64 comprising upper and lower insulators 66 and 68 has a central conductor 70 and up and down pass-throughs 72 and 74 permits a single wafer type to be used for the entire coil construction with it being flipped alternately upside down about a longitudinal axis to achieve the configuration shown diagrammatically in FIG. 16. The disadvantage of this embodiment, of course, is that it does not accord itself to standard photographic electronic component production wherein a conductor film is established on a single rigid insulative substrate.

Figure 4:
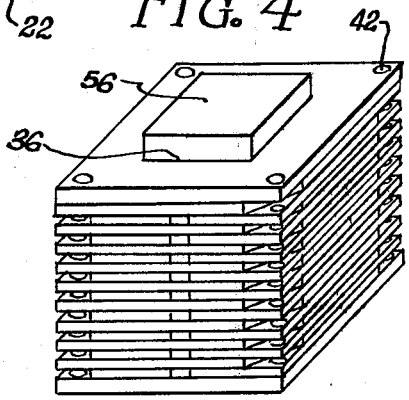
FIG. 4 is a perspective view of a completed coil stack according to the scheme of FIG. 1.
Figure 10:
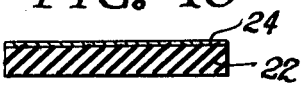
FIG. 10 is a section taken along line 10—10 of FIG. 7.
Figure 17:
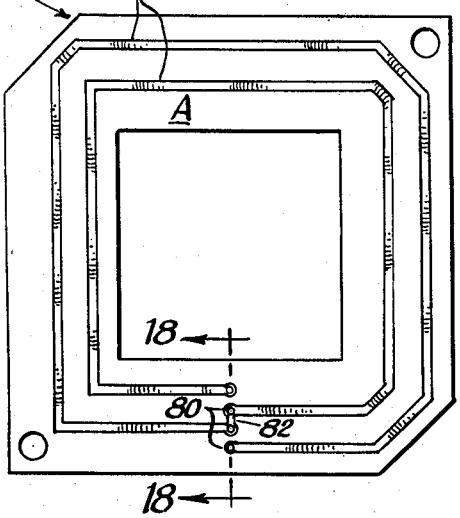
FIG. 17 is yet another embodiment of wafer.
Figure 18:
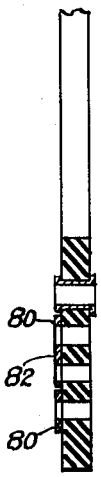
FIG. 18 is a section taken along line 18—18 of FIG. 17.
Figure 21:
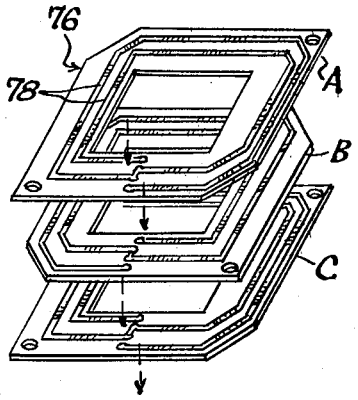
FIG. 21 is an exploded perspective of an inductor configuration made from unmodified wafers of the type shown in FIGS. 17 and 19.
Figure 19:
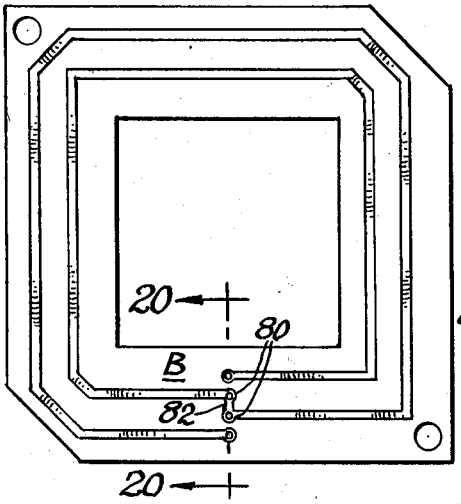
FIG. 19 is a top elevation view of a type (b) wafer of a general type shown in FIG. 17.
Figure 20:
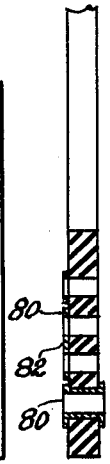
FIG. 20 is a section taken along line 20—20 of FIG. 19.
Figure 22:
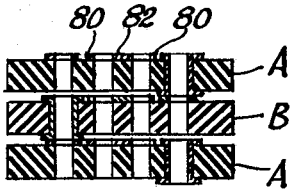
FIG. 22 is a section taken through a typical stack made according to FIG. 21.
Figure 23:
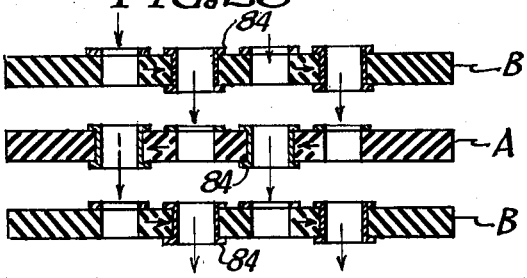
FIG. 23 is a section of a typical stack wherein the intermediate conductor bridges are broken and intermediate conductor rivets are installed.

Turning to yet another embodiment illustrated in FIGS. 17 though 23, it would, of course, be possible to modify the above described coil type by replacing the single conductor loop per wafer, with two or more loops which are either would in series, or define separate loops which connect to adjacent, corresponding separate loops with pass-throughs. An illustration of a combination of both these alternatives is shown in wafers 76 of FIGS. 17 and 19. These wafers, being provided in type (a) and type (b) for the same reason state above, utilize dual conductors 78 with intermediate contact points 80 defining receiving and pass-through connection points connected with a breakable bridge 82. In the configuration shown in FIGS. 17 through 20 the bridge is not broken and a standard conductor configuration similar to that shown in FIGS. 1 and 4 is established, except each wafer is double-wound, is shown. In order to create a coaxial pair of windings out of a single wafer stack, the bridges 82 are broken and a rivet-like pass-through connector 84 is pressed into the pre-drilled holes in the insulator to create a double coil as best seen in FIG. 23.

Figure 24:
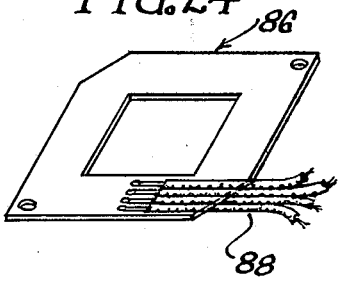
FIG. 24 is a perspective view of a typical lead wire arrangement.

In this last embodiment as in the others it is, of course, necessary to take off lead wires from certain of the wafers, and such a specialized wafer is shown in FIG. 24 at 86 wherein lead wires 88 are connected to the appropriate terminals and exit the wafer in any suitable manner.

Other variations would include the possibility of using half or partial coils, particularly in the embodiment shown in FIG. 4, in which a core is used and the half coils might be press-mated together around the existing core to define the coil. Additionally, ceramic insulators could be used, and in the event a capacitor alone is desired, a single element could be used with suitably positioned voids and contacts such that it could be flipped alternately upside down as as are wafers and the element in FIGS. 14 through 16 to create a capacitor. Wafers could be designed that could be ganged in parallel in groups of two or more to make high current windings, and the same basic technique could be used by arranging parallel conductor panels in a jig with suitable connections being made, and pouring in a liquid dialectric which would solidify to a solid mass, or remain liquid.

In any of its implementations, the invention sets forth a convenient style taking advantage of current manufacturing techniques for the creation of a wide variety coils, windings, resistors and reactive devices and even deflective coils such as for cathode ray tubes. In addition to those shown above, virtually any combination of current carrying capacity, concentrically wound multiple secondary transformers, and unitary filters and oscillator units can be created.

What is claimed is:

1. A superimposed wafer electrical element comprising:

(a) a series of wafers each having an insulative sheet and a conductor layer bonded to said insulative sheet;

(b) portions of said insulative sheet being removed to define at least one pass-through aperture and having a contact electrically connected to said conductor layer and passing through said aperture;

(c) said wafers being arranged in a stack such that by virtue of the electrical integrity established by the contact of each wafer contacting the subsequent wafer in said stack, an electrical element having pre-determined properties is created;

(d) said wafers may be flipped about a rotational axis for stacking, and said wafers fall into two types arranged relative to the rotation axis as follows:

(e) a type (a) wafer having receiving and pass-through contacts in a row parallel to and on one side of said axis and a void positioned at the virtual image of said receiving contact on the opposite side of said axis; and (f) a type (b) wafer having pass-through and receiving contacts positioned to align with the receiving and pass-through contacts of said type (a) wafers respectively, and defining a void positioned at the virtual image of said receiving contact on the opposite side of said axis, and including two insulator sheets, type (a) insulators having a void coincident with the receiving contact and the void of said type (a) wafers, and type (b) insulators having a void coinciding with the receiving contact and void of said type (b) wafers, whereby said wafers may be alternatively stacked to create a coil, or alternatively stacked in the following order to create a capacitor: Type (a) wafer, type (b) wafer upside down, type (b) insulator, type (b) wafer, type (a) wafer upside down, type (a) insulator, with this pattern repeating as desired.

* * * * *